US011837190B2

(12) United States Patent
Kim

(10) Patent No.: US 11,837,190 B2
(45) Date of Patent: Dec. 5, 2023

(54) DISPLAY APPARATUS AND CONTROL METHOD THEREOF

(71) Applicant: SAMSUNG ELECTRONICS CO., LTD., Suwon-si (KR)

(72) Inventor: Jinoh Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 3 days.

(21) Appl. No.: 17/684,668

(22) Filed: Mar. 2, 2022

(65) Prior Publication Data

US 2022/0189430 A1 Jun. 16, 2022

Related U.S. Application Data

(63) Continuation of application No. PCT/KR2020/009922, filed on Jul. 28, 2020.

(30) Foreign Application Priority Data

Sep. 2, 2019 (KR) ..... 10-2019-0108124

(51) Int. Cl.
*G09G 3/36* (2006.01)

(52) U.S. Cl.
CPC ... *G09G 3/3685* (2013.01); *G09G 2320/0252* (2013.01); *G09G 2320/0257* (2013.01); *G09G 2320/0673* (2013.01); *G09G 2330/02* (2013.01)

(58) Field of Classification Search
CPC ..... G09G 3/3685; G09G 2320/0252; G09G 2320/0257; G09G 2320/0673; G09G 2330/02
See application file for complete search history.

(56) References Cited

U.S. PATENT DOCUMENTS

| | | | | |
|---|---|---|---|---|
| 8,390,651 | B2 | 3/2013 | Huang et al. | |
| 2007/0046602 | A1 | 3/2007 | You et al. | |
| 2010/0016485 | A1 | 7/2010 | Liao et al. | |
| 2011/0063330 | A1 | 3/2011 | Bae et al. | |
| 2014/0160178 | A1* | 6/2014 | Hong | G09G 3/2007 345/80 |
| 2018/0374434 | A1* | 12/2018 | Hao | G09G 3/3607 |
| 2020/0013371 | A1* | 1/2020 | Yang | G06F 18/2413 |

FOREIGN PATENT DOCUMENTS

| | | | | |
|---|---|---|---|---|
| KR | 10-1407313 | B1 | 6/2014 | |
| KR | 10-2018-0002966 | A | 1/2018 | |
| KR | 10-2018-0058928 | A | 6/2018 | |
| KR | 10-2019-0100097 | A | 8/2019 | |
| KR | 2019100097 | A * | 8/2019 | G06K 9/627 |

* cited by examiner

*Primary Examiner* — Amare Mengistu
*Assistant Examiner* — Jennifer L Zubajlo
(74) *Attorney, Agent, or Firm* — Sughrue Mion, PLLC

(57) ABSTRACT

A display apparatus is provided. The display apparatus includes: a liquid crystal panel; a source driver configured to output a grayscale voltage to the liquid crystal panel; a power supply configured to provide a voltage to the source driver; and a controller configured to control the power supply and the source driver to change a maximum voltage provided to the source driver and a grayscale voltage based on conversion of a screen mode, and to set a predetermined grayscale region and an over driving region within an entire grayscale region.

13 Claims, 8 Drawing Sheets

DISPLAY APPARATUS AND CONTROL METHOD THEREOF

CROSS-REFERENCE TO RELATED APPLICATIONS

This application is a bypass continuation of PCT International Application No. PCT/KR2020/009922, filed on Jul. 28, 2020, which is based on and claims priority to Korean Patent Application No. 10-2019-0108124, filed on Sep. 2, 2019 in the Korean Intellectual Property Office, the disclosures of which are incorporated by reference herein in their entireties.

BACKGROUND

Field

The disclosure relates to a display apparatus with a liquid crystal panel having an increased response rate.

Description of Related Art

Liquid crystal displays (LCDs) may not immediately respond to a grayscale voltage due to capacitive loads of a storage capacitor Cst and a liquid crystal capacitor Clc of a liquid crystal panel, thereby causing an afterimage phenomenon in which a previous frame overlaps a current frame.

In order to remove the afterimage phenomenon, over driving has been used to increase motion of liquid crystals by applying a voltage higher than a grayscale voltage level corresponding to a gray level of a current frame in accordance with an amount of gray level changes between a previous frame and the current frame.

However, it is difficult to increase response rates at a high gray level due to a transient phenomenon generated in proportion to intensity of voltage additionally applied and limitation at a maximum gray level.

SUMMARY

One or more embodiments provide a display apparatus capable of increasing voltage levels of over driving and maximizing a voltage range of the over driving by expanding a grayscale voltage range via expansion of a driving voltage range of a source driver and by reducing a grayscale range of image data.

In accordance with an aspect of the disclosure, a display apparatus includes: a liquid crystal panel; a source driver configured to output a grayscale voltage to the liquid crystal panel; a power supply configured to provide a voltage to the source driver; and a controller configured to control the power supply and the source driver to change a maximum voltage provided to the source driver and a grayscale voltage based on conversion of a screen mode, and to set a predetermined grayscale region and an over driving region within an entire grayscale region.

The predetermined grayscale region may be a grayscale region other than a grayscale region between a maximum gray level and a predetermined gray level from the entire grayscale region.

The controller may be further configured to lower a gray level of image data to correspond to the predetermined grayscale region and provide the lowered gray level to the source driver.

The controller may be further configured to control the source driver to use a grayscale voltage in the over driving region as a voltage of over driving.

The controller may be further configured to, based on a gray level indicated by image data of a current frame being equal to or higher than the predetermined gray level, control the source driver to use a grayscale voltage corresponding to the over driving region as a voltage of over driving.

The controller may be further configured to control the source driver to increase a maximum positive polarity grayscale voltage and a maximum negative polarity grayscale voltage, respectively, based on the maximum voltage being increased according to the screen mode.

The controller may be further configured to identify the maximum positive polarity grayscale voltage and the maximum negative polarity grayscale voltage based on a voltage range in which a gray level linearly changes in accordance with a voltage change in the liquid crystal panel.

The controller may be further configured to control the source driver to increase grayscale voltages of respective gray levels based on increases in the maximum positive polarity grayscale voltage and the maximum negative polarity grayscale voltage.

The controller may be further configured to control the source driver to increase grayscale voltages of the respective gray levels while constantly maintaining a gamma curve in the predetermined grayscale region before and after conversion of the screen mode.

The controller may be further configured to control the source driver to increase grayscale voltages of the respective gray levels while changing the gamma curve in the over driving region before and after conversion of the screen mode.

The controller may be further configured to control the power supply to increase a common voltage based on an increase in the maximum voltage.

The controller may be further configured to control the power supply to increase the maximum voltage provided to the source driver based on conversion of the screen mode from a standard mode into a movie mode.

In accordance with an aspect of the disclosure, a method of controlling a display apparatus including a liquid crystal panel, a source driver configured to output a grayscale voltage to the liquid crystal panel, and a power supply configured to provide a voltage to the source driver, is provided. The method includes: controlling the power supply and the source driver to change a maximum voltage provided to the source driver and a grayscale voltage based on conversion of a screen mode; and setting a predetermined grayscale region and an over driving region within an entire grayscale region.

The predetermined grayscale region may be a grayscale region other than a grayscale region between a maximum gray level and a predetermined gray level from the entire grayscale region.

The method may further include lowering a gray level of image data to correspond to the predetermined grayscale region and providing the lowered gray level to the source driver.

In accordance with an aspect of the disclosure, a non-transitory computer readable recording medium is provided. The non-transitory computer readable recording medium has embodied thereon a program, which when executed by a processor of a display apparatus including a liquid crystal panel, a source driver configured to output a grayscale voltage to the liquid crystal panel, and a power supply configured to provide a voltage to the source driver, controls the display apparatus to execute a method, the method including: controlling the power supply and the source driver to change a maximum voltage provided to the source driver and a grayscale voltage based on conversion of a screen mode; and setting a predetermined grayscale region and an over driving region within an entire grayscale region.

DESCRIPTION OF DRAWINGS

The above and other aspects, features and advantages of certain embodiments of the present disclosure will be more apparent from the following description taken in conjunction with the accompanying drawings, in which.

DETAILED DESCRIPTION

Figure 1:
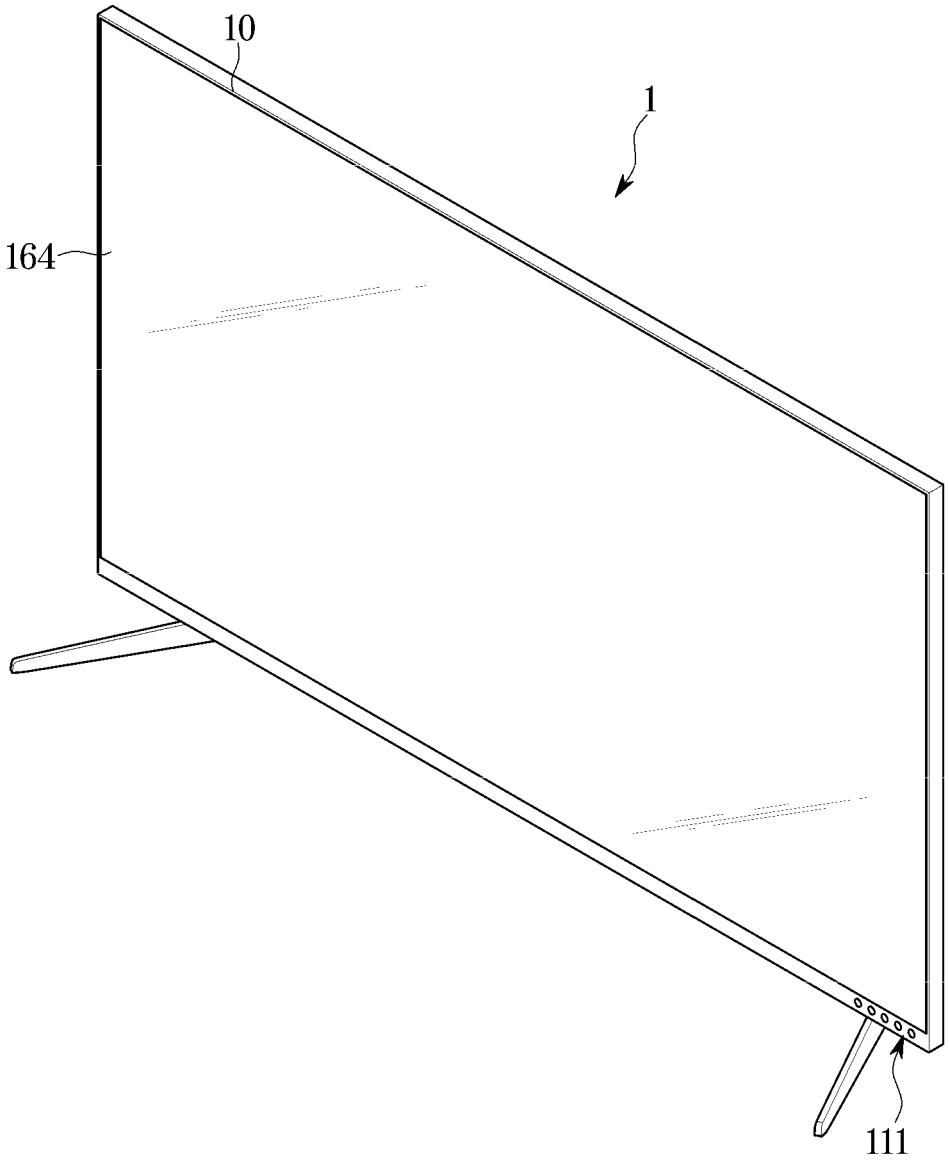
FIG. 1 is an exterior view of a display apparatus according to an embodiment.

Reference will now be made in detail to embodiments consistent with the present disclosure, examples of which are illustrated in the accompanying drawings. The embodiments described in the specification and shown in the drawings are only illustrative and are not intended to represent all aspects of the present disclosure.

Throughout the specification, when an element is referred to as being "connected to" another element, it may be directly or indirectly connected to the other element and the "indirectly connected to" includes connected to the other element via a wireless communication network.

The terminology used herein is for the purpose of describing particular embodiments and is not intended to be limiting. As used herein, the singular forms are intended to include the plural forms as well, unless the context clearly indicates otherwise. Throughout the specification, the terms "include" or "have" are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

As used herein, the terms "1st" or "first" and "2nd" or "second" may use corresponding components regardless of importance or order and are used to distinguish a component from another without limiting the components. Further, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

In addition, the terms "unit", "device", "block", "member", and "module" used herein refer to a unit used to process at least one function or operation. For example, these terms may refer to one or more hardware components such as field-programmable gate array (FPGA) or application specific integrated circuit (ASIC), one or more software components stored in a memory, or one or more processors.

The reference numerals used in operations are used for descriptive convenience and are not intended to describe the order of operations and the operations may be performed in a different order unless otherwise stated.

Hereinafter, embodiments of the present disclosure will be described with reference to the accompanying drawings.

FIG. 1 is an exterior view of a display apparatus according to an embodiment.

Referring to FIG. 1, a display apparatus 1 according to an embodiment is an apparatus that processes image data received from an external device and visually displays an image.

As shown in FIG. 1, the display apparatus 1 may be implemented as a TV, but examples of the display apparatus 1 are not limited thereto. For example, the display apparatus 1 may be implemented as monitors of computers or included in navigation devices, various portable terminal devices, and the like. In this regard, the portable terminal devices may be notebook computers, smartphones, tablet PCs, personal digital assistants (PDAs), or the like.

The display apparatus 1 includes a main body 10 constituting an external appearance of the display apparatus 1 and configured to accommodate and support various parts of the display apparatus 1 and a liquid crystal panel 164 configured to display an image.

The main body 10 may be provided with an input button 111 to receive an input of a user's command to turn on/off power of the display apparatus 1, to control a volume, to adjust a channel, to convert a screen mode, and the like. In addition, separately from the input button 111 provided at the main body 10, a remote controller may be provided to receive an input of a user's command related to the control of the display apparatus 1.

In general, the liquid crystal panel 164 displays image data by adjusting an amount of light that may be transmitted through two substrates by applying a grayscale voltage to a liquid crystal layer including a liquid crystal material having anisotropic dielectric constant and injected between the two substrates.

More particularly, because the liquid crystal panel 164 cannot emit light by itself, the display apparatus 1 may include a backlight unit (BLU) configured to backlight the liquid crystal panel 164. Therefore, the display apparatus 1 may display image data by adjusting transmittance of the liquid crystal layer by controlling intensity of the grayscale voltage applied to the liquid crystal layer of a liquid crystal panel 20.

Backlight units may be implemented by direct-type or edge-type backlight units and may also be implemented by various forms well known in the art.

The liquid crystal panel 164 may include pixels. In this regard, a pixel is a minimum unit constituting a screen displayed through the liquid crystal panel 164 and is also referred to as a dot, but hereinafter, the pixel will be used for descriptive convenience.

Each pixel may receive an electrical signal expressing image data and output an optical signal corresponding to the received electrical signal. As such, the image data may be displayed on the liquid crystal panel 164 by combining the optical signals output from a plurality of pixels included in the liquid crystal panel 164.

In this case, each pixel is provided with a pixel electrode connected to a gate line and a source line. The gate line and the source line may be configured by any method well known in the art, and detailed descriptions thereof will be omitted.

Hereinafter, each of the components of the display apparatus 1 will be described in detail, and a method of maximizing a voltage range of over driving while increasing voltage levels of the over driving for increasing a response rate of the liquid crystal panel 164 will be described briefly.

Figure 2:
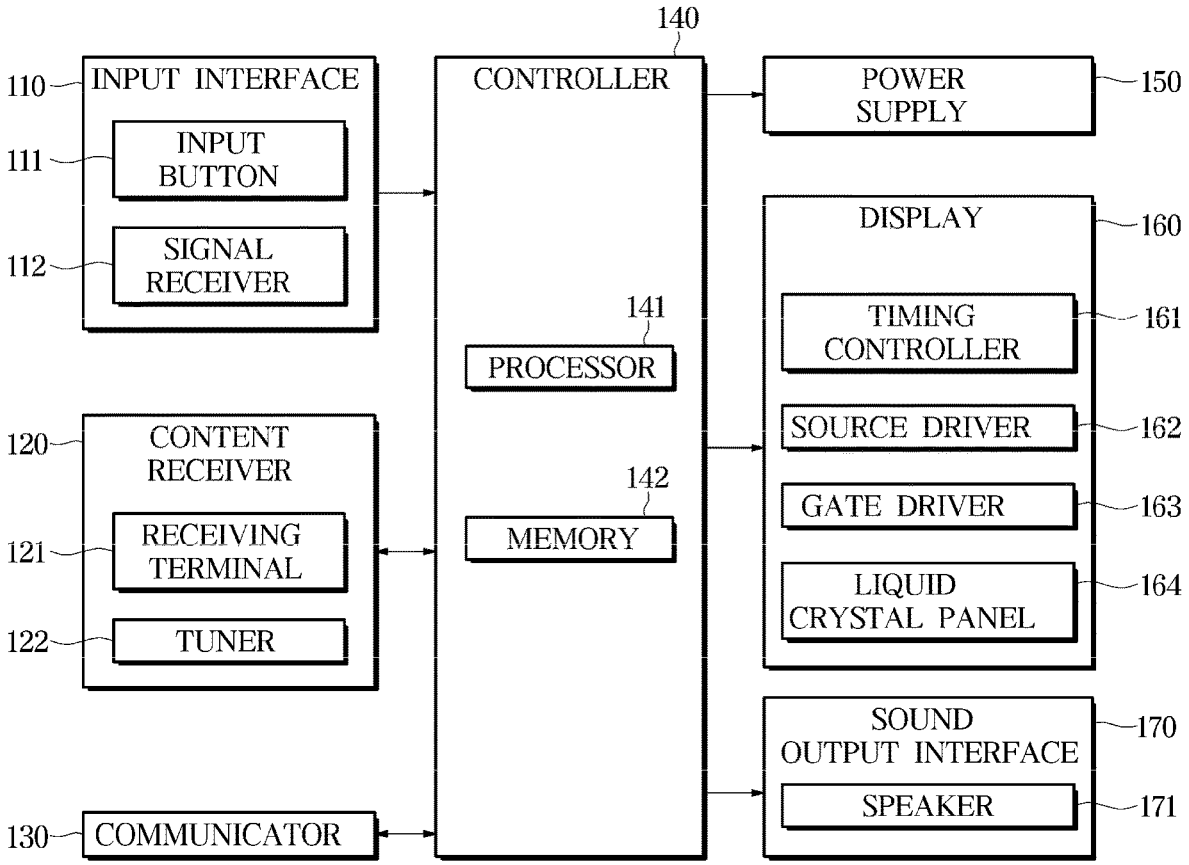
FIG. 2 is a control block diagram of a display apparatus according to an embodiment.
Figure 3:
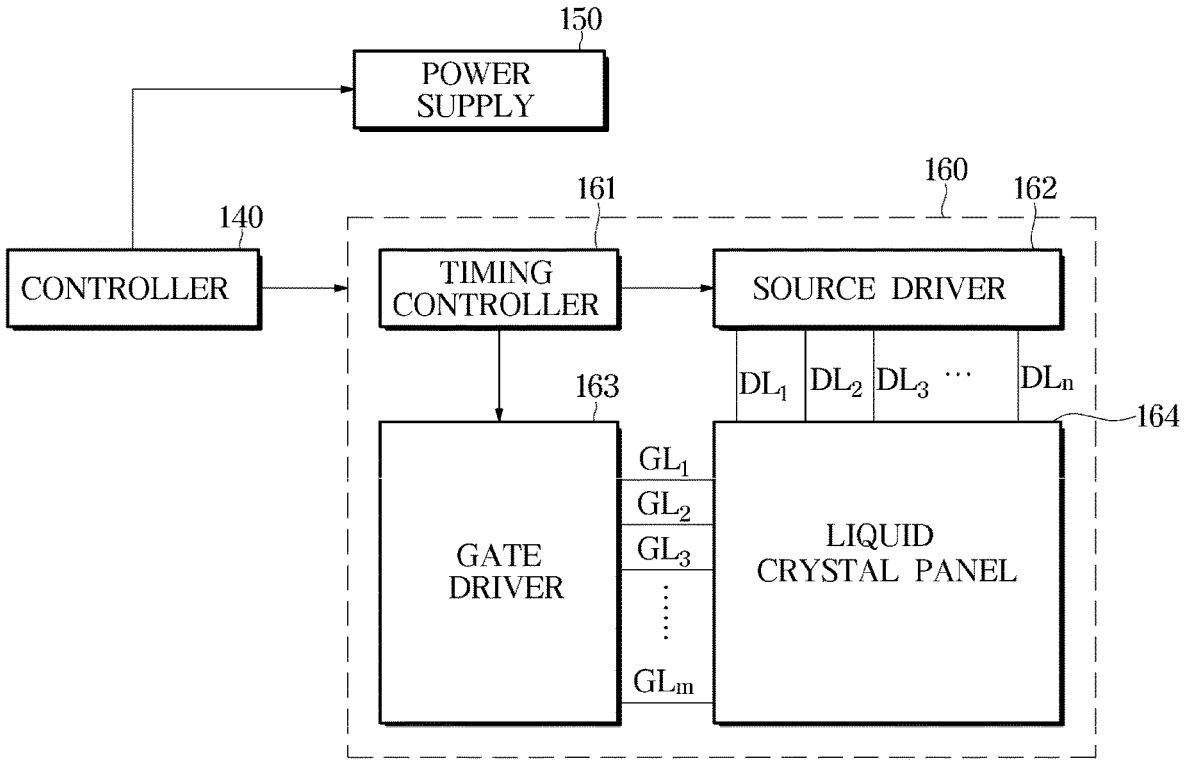
FIG. 3 is a control block diagram of a display according to an embodiment illustrated in more detail.

FIG. 2 is a control block diagram of the display apparatus 1 according to an embodiment. FIG. 3 is a control block diagram of a display 160 according to an embodiment illustrated in more detail.

Referring to FIG. 2, the display apparatus 1 according to an embodiment includes an input interface 110 configured to receive various control commands from a user, a content receiver 120 configured to receive contents including image and sound from an external device, a communicator 130 (i.e., communication interface) configured to transmit/receive various data such as contents via a communication network, a controller 140 configured to control the display 160 to display an image based on the image data of the contents and adjust a voltage applied to the display 160 based on conversion of a screen mode, a power supply 150 configured to apply a voltage to the display 160 in accordance with the control of the controller 140, the display 160 to display an image in accordance with the control of the controller 140, and a sound output interface 170 configured to output sounds in accordance with the control of the controller 140.

The input interface 110 according to an embodiment may receive various control commands from the user.

For example, the input interface 110 may include an input button 111 as shown in FIG. 2. The input button 111 according to an embodiment may include a power button to turn on/off power of the display apparatus 1, a channel button to adjust a communication channel received from the content receiver 120, and a volume button to adjust a volume of sounds output from the sound output interface 170. Besides, the input interface 110 may receive a control command to convert the screen mode of the display apparatus 1 from the user via the above-described input button 111.

The screen mode may include, for example, a standard mode satisfying gamma 2.2. standards, a dynamic mode with an increased contrast ratio, a natural mode with enhanced color reproduction, and a movie mode limiting a grayscale range to realize feelings in a movie theater, and examples of the screen mode are not limited thereto and may be generated by the user by adjusting brightness and gamma characteristics.

Various buttons included in the input button 111 may employ a push switch and a membrane switch to detect a user's pressure or a touch switch to detect a contact with a part of the user's body. However, embodiments are not limited thereto, and the input button 111 may employ various input devices capable of outputting an electrical signal to the controller 140 in response to a particular operation of the user.

Also, the input button 111 according to an embodiment may include a signal receiver 112 configured to receive a remote-control signal of a remote controller.

In this case, the remote controller configured to acquire a user input may be provided separated from the display apparatus 1 may acquire the user input, and may transmit a wireless signal corresponding to the user input to the display apparatus 1.

The signal receiver 112 may receive the wireless signal from the remote controller and output an electrical signal corresponding to the user input to the controller 140.

Besides, the input interface 110 may include various known components capable of receiving a control command from the user, without limitation. In addition, when the liquid crystal panel 164 is implemented as a touch screen type, the liquid crystal panel 164 may also perform the function of the input interface 110.

The content receiver 120 according to an embodiment may include a receiving terminal 121 and a tuner 122 configured to receive contents including image data and/or sound signals from content sources.

The receiving terminal 121 may include an RF coaxial cable connector configured to receive broadcast signals including contents from an antenna, a high-definition multimedia interface (HDMI) connector configured to receive contents from a set-top box or a multimedia reproduction device, a component video connector, a composite video connector, a D-sub connector, and the like.

The tuner 122 may receive broadcast signals from a broadcast-receiving antenna or a wired cable and extract broadcast signals of a channel selected by the user among the broadcast signals. For example, the tuner 122 may pass a broadcast signal having a frequency corresponding to the channel selected by the user among a plurality of broadcast signals received via the broadcast-receiving antenna or the wired cable and block broadcast signals having different frequencies.

As such, the content receiver 120 may receive image data and sound signals from content sources via the receiving terminal 121 and/or the tuner 122 and output the image data and/or the sound signals to the controller 140.

The communicator 130 according to an embodiment may receive various contents via a wireless or wired communication network. To this end, the communicator 130 may include a wireless communication module supporting wireless communication protocols and a wired communication module supporting wired communication protocols.

The wireless communication may include cellular communication using, for example, at least one of $5^{th}$ generation (5G), LTE, LTE Advance (LTE-A), code division multiple access (CDMA), wideband CDMA (WCDMA), universal mobile telecommunications system (UMTS), wireless broadband (Wibro), and global system for mobile communications (GSM). According to an embodiment, the wireless communication may include, for example, at least one of wireless fidelity (WiFi), Bluetooth, Bluetooth Low Energy (BLE), Zigbee, near field communication (NFC), magnetic secure transmission, radio frequency (RF), or body area network (BAN). According to an embodiment, the wireless communication may include global navigation satellite system (GNSS).

Also, the wired communication protocols may be peripheral component interconnect (PCI), PCI-express, universe serial bus (USB), or the like, but are not limited thereto.

The controller 140 according to an embodiment may include at least one memory 142 that stores a program performing operations described above and below and at least one processor 141 configured to execute the stored program.

The processor 141 according to an embodiment may control the content receiver 120, the communicator 130, the power supply 150, the display 160, and the sound output interface 170 based on the control command received from the input interface 110.

For example, upon receiving a control command to convert the screen mode via the input interface 110, the processor 141 may control the power supply 150, the display 160, and the sound output interface 170 to provide brightness and gamma characteristics corresponding to the screen mode.

Specifically, when a command to convert into a screen mode limiting a grayscale range (e.g., movie mode) is received via the input interface 110 while a screen mode not limiting the grayscale range (e.g., standard mode) is performed, the processor 141 may expand a driving voltage range of a source driver 162 by controlling the power supply 150 to increase a maximum voltage applied to the source driver 162 of the display 160.

In this case, the processor 141 may control the source driver 162 to increase grayscale voltages of the previous grayscale to correspond to the increase in the maximum voltage. That is, the processor 141 may expand a positive polarity grayscale voltage range and a negative polarity grayscale voltage range by controlling the source driver 162 to increase a maximum positive polarity grayscale voltage and a maximum negative polarity grayscale voltage respectively in accordance with the increase in the maximum voltage supplied to the source driver 162. The increase in the maximum voltage and the grayscale voltage supplied to the source driver 162 will be described again in more detail.

In addition, in the controlling to increase the maximum voltage applied to the source driver 162 and the grayscale voltage, the processor 141 may set a grayscale region other than a predetermined grayscale region as an over driving region (e.g., gray levels from 220 to 255). In this case, the predetermined grayscale region (e.g., gray levels from 0 to 220) may correspond to a grayscale region defined by excluding a grayscale region between a maximum gray level (e.g., gray level of 255) and the predetermined gray level (e.g., gray level of 220) from the entire grayscale region (e.g., gray levels from 0 to 255). Hereinafter, the entire grayscale region of 0 to 255 will be described as an example, but embodiments are not limited thereto. Any grayscale region with various magnitudes may be used in accordance with the number of bits allocated to the grayscale.

In this regard, the processor 141 may acquire image data corresponding to contents based on image processing performed on the contents obtained via the content receiver 120 or the communicator 130, lower the grayscale of the image data to correspond to the predetermined grayscale region by shrinking the image data, and transmit the resultant to the source driver 162.

That is, the processor 141 may lower the gray level of each of the pixels included in the image data by a predetermined ratio such that the image data uses gray levels of the predetermined grayscale region and transmit the shrunk image data to a timing controller 161 so that the source driver 162 drive the liquid crystal panel 164 with a grayscale voltage corresponding to the predetermined grayscale region.

In addition, the processor 141 may control the source driver 162 to use a grayscale voltage of the over driving region as a voltage of over driving.

Specifically, when a gray level of the image data of a current frame is equal to or higher than a predetermined gray level, the processor 141 may control the source driver 162 to use a grayscale voltage corresponding to the over driving region as a voltage of over driving.

That is, the processor 141 may control the source driver 162 to apply the grayscale voltage of the over driving region for a high-grayscale region over the predetermined gray level of the predetermined grayscale region, thereby increasing a response rate in the high-grayscale region.

In other words, in the case where a gray level of shrunk image data corresponds to a high-grayscale region over the predetermined gray level, the processor 141 may control the source driver 162 to perform over driving by applying the grayscale voltage of the over driving region.

In this case, a grayscale voltage with a greater magnitude than that of the previous voltage before conversion of the screen mode may be allocated to the over driving range based on the increase in the driving voltage applied to the source driver 162 and the grayscale voltage in accordance with the conversion of the screen mode. Accordingly, over driving may be performed more efficiently, thereby increasing the response rate.

That is, the voltage level of the over driving may further be increased after conversion of the screen mode, and the voltage range of the over driving may be expanded.

In this case, when a gray level indicated by the shrunk image data corresponds to a low gray level less than a predetermined gray level, the processor 141 may control the source driver 162 to perform over driving by applying a grayscale voltage corresponding to a gray level higher than the gray level indicated by the image data by a predetermined ratio. The performing over driving will be described below in more detail.

The memory 142 according to an embodiment may store information on correlation between the grayscale and the grayscale voltage, i.e., information on gamma curve, and information on adjustment of the grayscale voltage in accordance with the conversion of the screen mode.

As such, the memory 142 may be implemented using a non-volatile memory device such as cache memory, Read Only Memory (ROM), Programmable ROM (PROM), Erasable Programmable ROM (EPROM), Electrically Erasable Programmable ROM (EEPROM), and flash memory, or a volatile memory device such as Random Access Memory (RAM) to store various information. However, embodiments are not limited thereto, and any type capable of storing various information may also be used as the memory 142.

The power supply 150 according to an embodiment may apply a voltage to the display 160.

Specifically, the power supply 150 may apply driving voltages to the source driver 162 and a gate driver 163 respectively and a common voltage (Vcom) required for the liquid crystal layer of the liquid crystal panel 164 via each pixel electrode.

To this end, the power supply 150 may include a DC/DC converter and a PWM driver and may be provided as a separate IC according to an embodiment.

The display 160 according to an embodiment may display an image by receiving in input of image data from the controller 140 and driving the liquid crystal panel 164 based on the input image data.

To this end, the display 160 includes the source driver 162, the gate driver 163, and the timing controller 161 configured to control the overall operation of the source driver 162 and the gate driver 163 by transmitting a gate control signal and a source control signal.

Also, as shown in FIG. 3, the display 160 includes the liquid crystal panel 164 including a plurality of gate lines (GL1, GL2, GL3 • • • GLm) to transmit gate signals, a plurality of source lines (DL1, DL2, DL3 • • • DLn) formed to intersect the gate lines (GL1, GL2, GL3 • • • GLm) and transferring grayscale voltages, and a plurality of pixel electrodes respectively formed in areas surrounded by the gate lines (GL1, GL2, GL3 • • • GLm) and the source lines (DL1, DL2, DL3 • • • DLn) in a matrix form and connected via switching devices serving as switches between the gate lines (GL1, GL2, GL3 • • • GLm) and the source lines (DL1, DL2, DL3 • • • DLn).

The switching device may be a thin film transistor (TFT) according to an embodiment and may also be implemented by various devices well known in the art.

In this case, each of the pixels may display image data by adjusting light transmittance by rotating liquid crystals of the liquid crystal layer by an electric field formed between a pixel electrode to which the grayscale voltage is applied through the thin film transistor and a common electrode to which the common voltage (Vcom) is applied.

The timing controller 161 according to an embodiment may receive an input of color data and image data including an image control signal from the controller 140. For example, the image control signal may include a vertical synchronizing signal (Vsync), a horizontal synchronizing signal (Hsync), a main clock signal (MCLK), a data enable signal (DE), and the like.

The timing controller 161 may generate a source control signal to control the source driver 162 and a gate control signal to control the gate driver 163 based on the input image control signal. For example, the timing controller 161 may output the source control signal and color data to the source driver 162 and output the gate control signal to the gate driver 163.

The source driver 162 according to an embodiment may set output timing of the grayscale voltage, magnitude and polarity of the grayscale voltage, and the like in accordance with the source control signal and color data received from the timing controller 161, and output an appropriate grayscale voltage via the source lines (DL1, DL2, DL3 • • • DLn) according to application timing.

In addition, the source driver 162 performs inversion driving periodically according to an inversion cycle through a reference reverse signal. For example, the reference reverse signal include a reverse signal REV, a polarity control signal POL, and the like to invert the polarities of the pixel electrodes connected to the source driver 162.

The source driver 162 may include at least one source drive integrated circuit (IC), and the number of the source driver ICs may be determined according to specifications, such as the size and resolution, of the liquid crystal panel 164.

In this regard, the source driver 162 may convert the image data received from the controller 140 via the timing controller 161 into a grayscale voltage in an analog form based on the driving voltage received from the power supply 150 and apply the grayscale voltage to the source lines (DL1, DL2, DL3 • • • DLn) aligned on the liquid crystal panel 164.

The source driver 162 may perform over driving to apply a voltage higher than the grayscale voltage corresponding to the gray level indicated by the image data according to an embodiment. This will be described below in more detail.

The gate driver 163 according to an embodiment may be connected one end or both ends of the gate lines (GL1, GL2, GL3 • • • GLm), generate a plurality of gate signals using the gate control signal received from the timing controller 161 and gate on/off voltages received from the power supply 150, and apply the gate signals to the gate lines (GL1, GL2, GL3 • • • GLm) aligned on the liquid crystal panel 164.

The gate driver 163 may include at least one gate drive integrated circuit (IC), and the number of the gate drive ICs may be determined according to specifications, such as the size and resolution, of the liquid crystal panel 164.

That is, upon receiving the gate control signal, the gate driver IC of the gate driver 163 may apply an on/off voltage, i.e., an on/off signals sequentially through the gate lines. Accordingly, the gate driver IC may sequentially turn on/off the switching devices connected to the gate lines.

Accordingly, color data that is to be displayed on the pixels connected to the gate lines may be converted into grayscale voltages divided into a plurality of voltages and applied to the respective source lines. In this regard, a gate signal is applied sequentially to all of the gate lines for one frame period, and grayscale voltages corresponding to the color data are applied to all rows of the pixels so that an image of one frame is displayed on the liquid crystal panel 164.

In the case where an electric field of the same direction, i.e., the same polarity, continues to be applied to the pixel electrodes of the display apparatus 1, an afterimage may remain due to characteristics of the liquid crystal material, resulting in deterioration of image quality. Therefore, it is necessary to invert the polarity of the grayscale voltage with respect to the common voltage.

In this regard, the polarity may be determined as a positive polarity or a negative polarity with respect to the common voltage. For example, when a certain pixel receives a grayscale voltage of a positive polarity for a predetermined frame, the pixel needs to receive a grayscale voltage of a negative polarity for another predetermined frame. As a result, the polarity of a grayscale voltage applied to a certain pixel needs to change between a positive polarity and a negative polarity repeatedly. The polarity may be sequentially inverted at an interval of a frame, at an interval of a plurality of frames, or at a specific frame. As such, the inversion cycle is not particularly limited. Therefore, a driving method such as a dot inversion driving method, in which the polarity is inverted according to an inversion cycle, has been used in the liquid crystal panel 20.

The sound output interface 170 according to an embodiment may receive sound data of contents received via the content receiver 120 or the communicator 130 in accordance with the control of the processor 141 and output sounds. In this case, the sound output interface 170 may include one or more speakers 171 to convert electrical signals into sound signals.

The components of the display apparatus 1 are described above in detail. Hereinafter, an operation of maximizing a voltage range of over driving by expanding a driving voltage range of the source driver 162 based on conversion of the screen mode, and reducing a grayscale range of image data will be described in detail.

Figure 4:
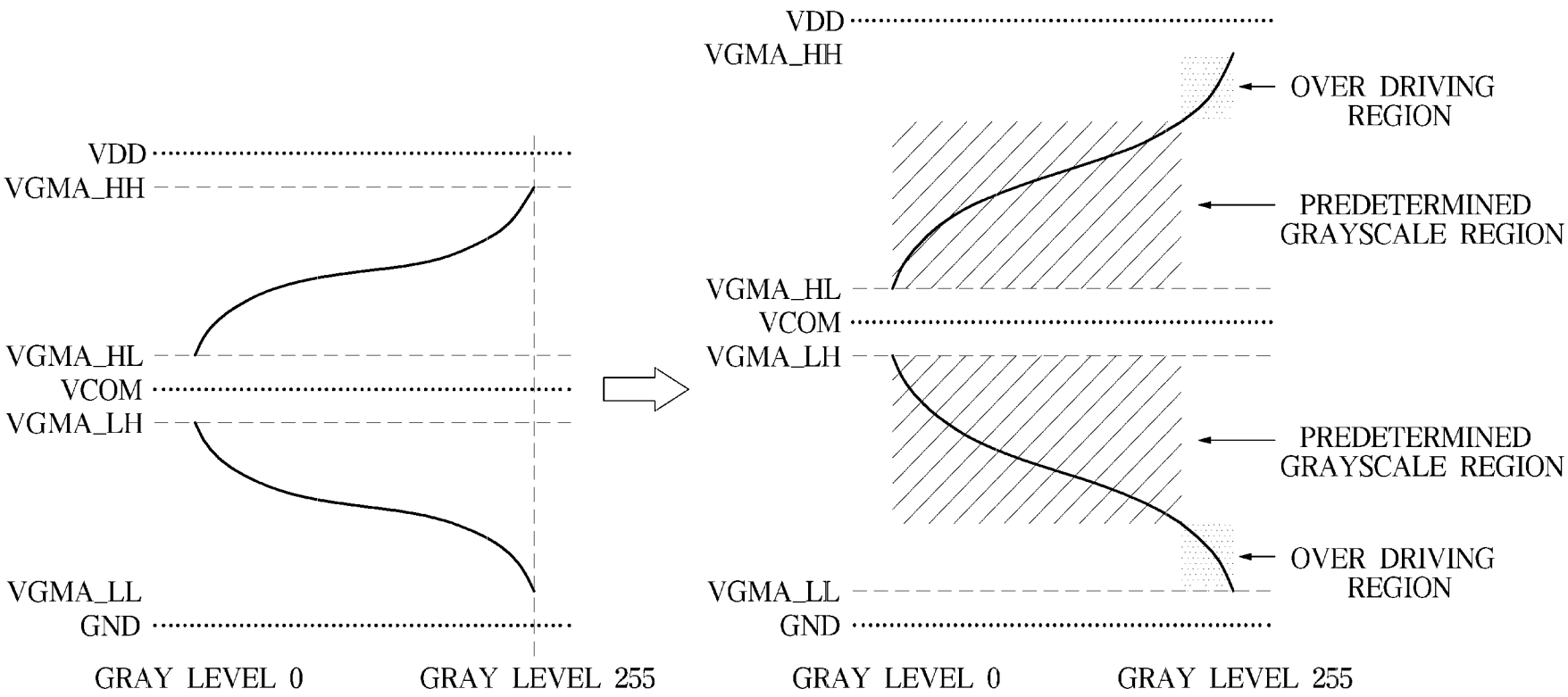
FIG. 4 is a diagram illustrating a gamma curve adjusted based on an increase in voltage of a source driver according to an embodiment.
Figure 5:
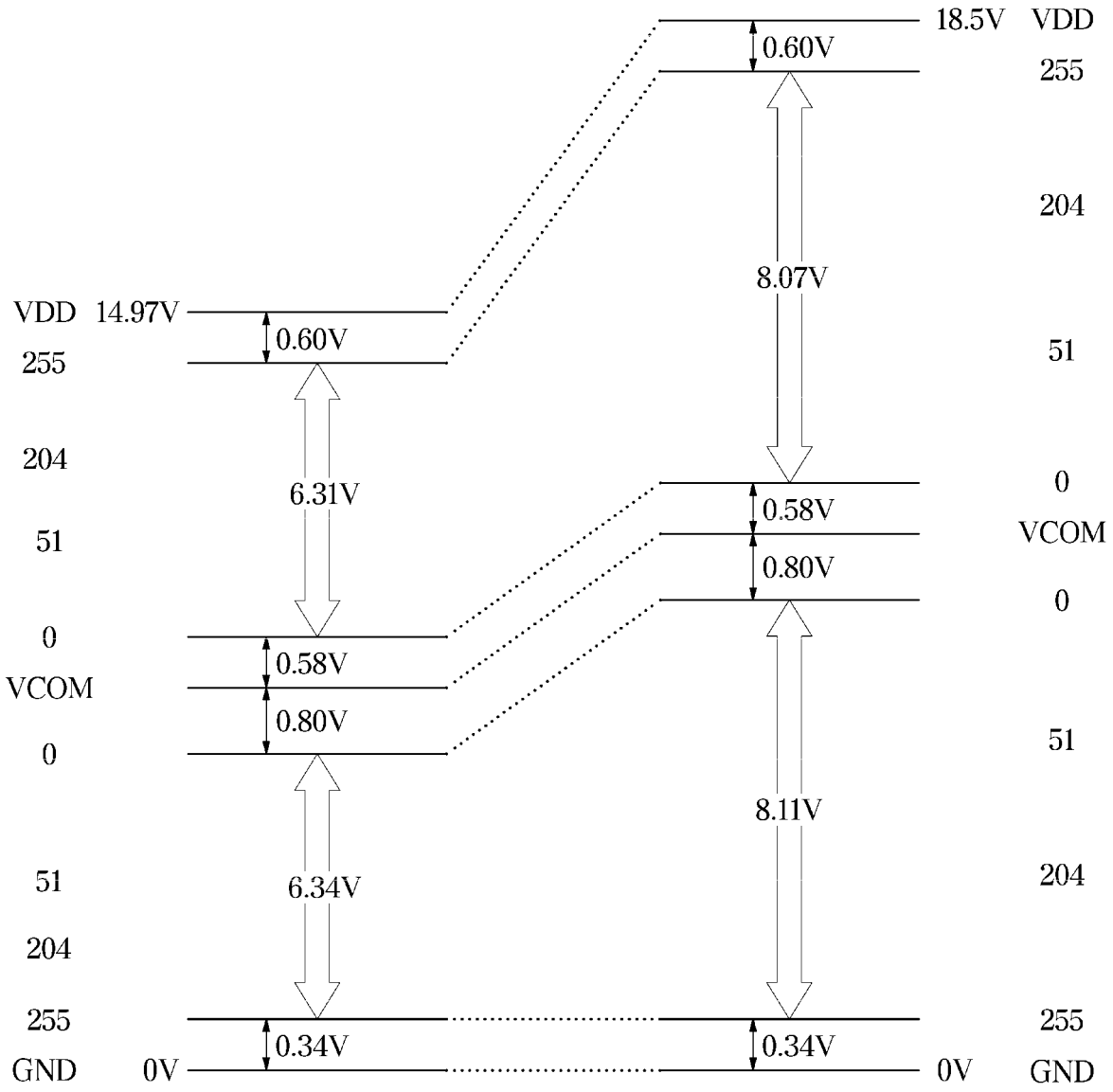
FIG. 5 is a diagram illustrating grayscale voltage levels adjusted based on an increase in voltage of a source driver according to an embodiment.
Figure 6:
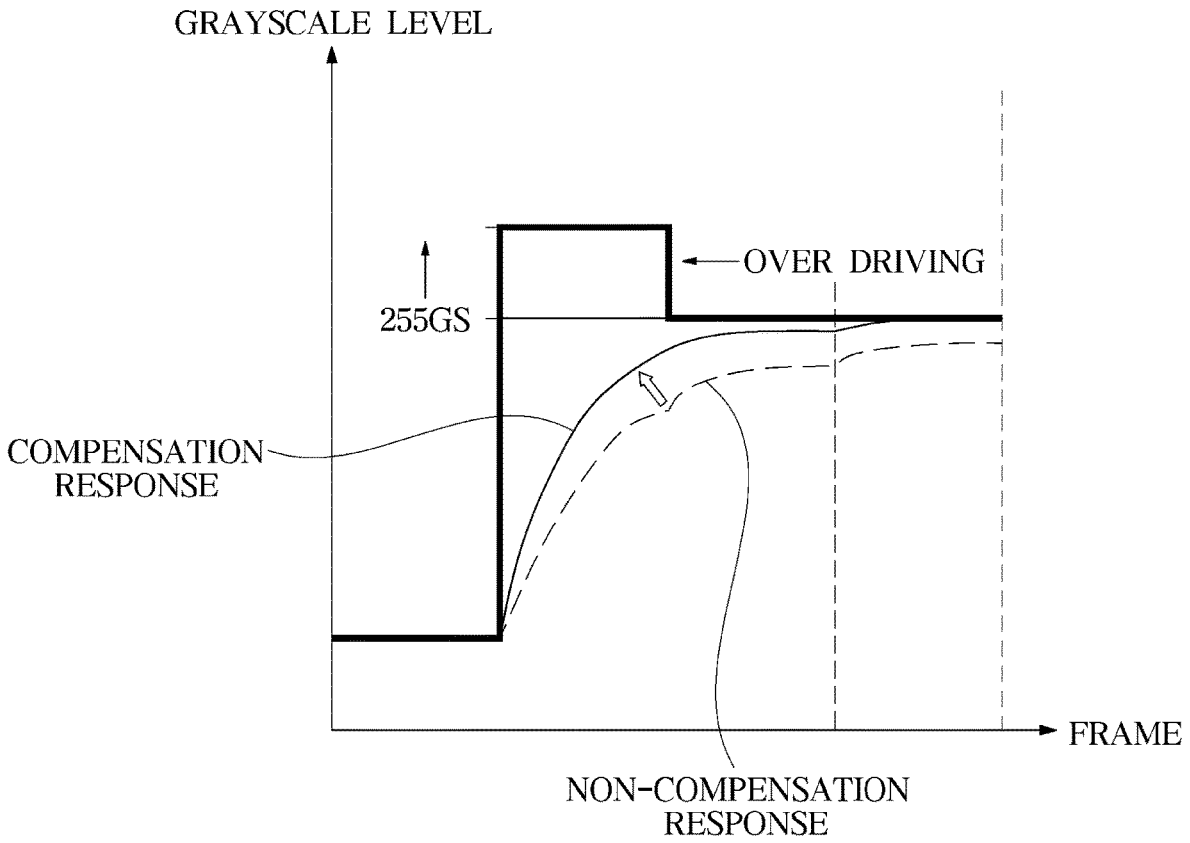
FIG. 6 is a diagram for describing over driving of a display apparatus according to an embodiment.

FIG. 4 is a diagram illustrating a gamma curve adjusted based on an increase in voltage of the source driver 162 according to an embodiment. FIG. 5 is a diagram illustrating grayscale voltage levels adjusted based on the increase in voltage of the source driver 162. FIG. 6 is a diagram for describing over driving of the display apparatus 1 according to an embodiment.

Referring to FIG. 4, the processor 141 according to an embodiment may control the power supply 150 to increase the maximum voltage VDD applied to the source driver 162 based on conversion of the screen mode. For example, as shown in FIG. 5, in response to the conversion of the screen mode, the maximum voltage VDD may be increased from 14.97 V to 18.5 V. Accordingly, the source driver 162 may obtain a wider driving voltage range as shown in FIGS. 4 and 5.

In this case, conversion of the screen mode may be conversion from a screen mode not limiting a grayscale range (e.g., standard mode) into a screen mode limiting a grayscale range (e.g., movie mode), and the conversion of the screen mode may be performed based on the control command of the user input via the input interface 110 or automatically performed based on types of contents in accordance with well-known algorithms.

The processor 141 according to an embodiment may control the source driver 162 to increase grayscale voltages allocated to all gray levels respectively in response to the increase in the maximum voltage VDD applied to the source driver 162.

Specifically, the processor 141 may expand a positive polarity grayscale voltage range VGMA_HL to VGMA_HH and a negative polarity grayscale voltage range VGMA_LL to VGMA_LH by controlling the source driver 162 to increase a maximum positive polarity grayscale voltage VGMA_HH and a maximum negative polarity grayscale voltage VGMA_LH, respectively, in response to the increase in the maximum voltage VDD applied to the source driver 162.

In this case, the maximum grayscale voltages VGMA_HH and VGMA_LH increasing based on the conversion of the screen mode may be determined based on a voltage range in which gray levels of the liquid crystal panel 164 linearly change in accordance with voltage changes.

That is, the processor 141 may determine voltages, at which liquid crystals linearly rotate in the liquid crystal layer of the liquid crystal panel 164 within the maximum voltage VDD level, as maximum grayscale voltages VGMA_HH and VGMA_LH. In other words, the liquid crystals may not rotate any more at a voltage equal to or higher than the maximum grayscale voltage level.

In this regard, the processor 141 may control the source driver 162 to increase grayscale voltages of respective gray levels in response to the increases in the maximum positive polarity grayscale voltage VGMA_HH and the maximum negative polarity grayscale voltage VGMA_LH, respectively.

That is, the processor 141 may control the source driver 162 to reallocate the grayscale voltages allocated to the respective gray levels in accordance with the increased maximum grayscale voltages VGMA_HH and VGMA_LH. For example, a grayscale voltage corresponding to a gray level of 51 may be reallocated from 9.614 V to 11.81 V.

In this case, the processor 141 may control the power supply 150 to increase the common voltage VCOM as well to correspond to the increase in the maximum voltage VDD applied to the source driver 162.

Accordingly, the grayscale voltage range may be expanded as shown in FIG. 5 in the entire grayscale. For example, a range of the positive polarity grayscale voltage may be expanded from 6.31 V to 8.07 V, and a range of the negative polarity grayscale voltage may be expanded from 6.34 V to 8.11 V.

As the grayscale voltage range is expanded in the entire grayscale as described above, voltage level intervals between the gray levels may be expanded, and accordingly, as shown in FIG. 4, the gamma curve may appear differently before and after the screen mode is converted.

After the screen mode is converted, the gamma curve may correspond to a curve in which the grayscale voltage rises in the form of a quadratic curve in accordance with the grayscale according to an embodiment as shown in FIG. 4.

In addition, when controlling to increase the maximum voltage applied to the source driver 162 and the grayscale voltage, the processor 141 may set a grayscale region other than the predetermined grayscale region as an over driving region (e.g., gray levels from 220 to 255). In this case, the predetermined grayscale region (e.g., gray levels from 0 to 220) may correspond to a grayscale region defined by excluding a grayscale region between a maximum gray level (e.g., gray level of 255) and a predetermined gray level (e.g., gray level of 220) from the entire grayscale region (e.g., gray levels from 0 to 255).

In this regard, the processor 141 may obtain image data corresponding to contents based on image processing of the contents obtained via the content receiver 120 or the communicator 130, lower the gray levels of the image data to correspond to the predetermined grayscale region by shrinking the image data, and transmit the resultant to the source driver 162.

That is, the processor 141 may lower gray levels of the respective pixels included in image data by a preset ratio such that the image data uses only the gray levels of the predetermined grayscale region and transmit the shrunk image data to the source driver 162 via the timing controller 161, so that the source driver 162 may drive the liquid crystal panel 164 using grayscale voltages corresponding to the predetermined grayscale region.

In other words, the processor 141 may transmit image data exclusively composed of gray levels within the predetermined grayscale region to the timing controller 161, and the timing controller 161 may apply a source control signal to the source driver 162 based on the image data exclusively composed of gray levels within the predetermined grayscale region, so that the source driver 162 may apply a grayscale voltage corresponding to the predetermined grayscale region to the liquid crystal panel 164.

In addition, the processor 141 may control the source driver 162 to use a grayscale voltage of an over driving region (e.g., gray levels from 220 to 255) as a voltage of over driving.

Specifically, when a gray level indicated by image data of a current frame is equal to or higher than a predetermined gray level, the processor 141 may control the source driver 162 to use a grayscale voltage corresponding to the over driving region as a voltage of over driving.

That is, the processor 141 may increase a response rate in a high-grayscale region by controlling the source driver 162 to apply the grayscale voltage of the over driving region for a high-gray level higher than a predetermined gray level of the predetermined grayscale region.

In other words, when a gray level indicated by image data after shrinking corresponds to a high gray level higher than a predetermined gray level, the processor 141 may control the source driver 162 to perform over driving by applying a grayscale voltage of the over driving region.

In this case, a grayscale voltage with a greater magnitude may be allocated to the over driving region in comparison with that allocated before conversion of the screen mode in accordance with increases in driving voltage applied to the source driver 162 and grayscale voltage in response to conversion of the screen mode, and therefore over driving may be performed more efficiently, thereby increasing the response rate.

For example, as shown in FIG. 6, even when a gray level indicated by image data of a current frame corresponds to 255 (maximum gray level), the display apparatus 1 may provide a quicker response rate than a response rate when there is no compensation by applying a voltage higher than a grayscale voltage corresponding to the gray level as a voltage of over driving by shrinking the image data and increasing the driving voltage range and the grayscale voltage range of the source driver 162.

In other words, the display apparatus 1 may obtain an over driving voltage in a higher voltage level by limiting the grayscale range of image data and expanding the driving voltage and the grayscale voltage of the source driver 162, thereby providing an increase in response rates in a high-gray level.

In this case, when a gray level indicated by the shrunk image data corresponds to a low gray level less than a predetermined gray level, the processor 141 may control the source driver 162 to perform over driving by applying a grayscale voltage corresponding to a gray level lower than the gray level indicated by the image data by a predetermined ratio.

As a result, the display apparatus 1 may increase the voltage level of over driving in a high gray level and expand the voltage range of over driving by expanding the driving voltage range and the grayscale voltage range of the source driver 162 and reducing the grayscale range used by the image data, so that the response rate of the liquid crystals may be increased in the high gray level.

Figure 7:
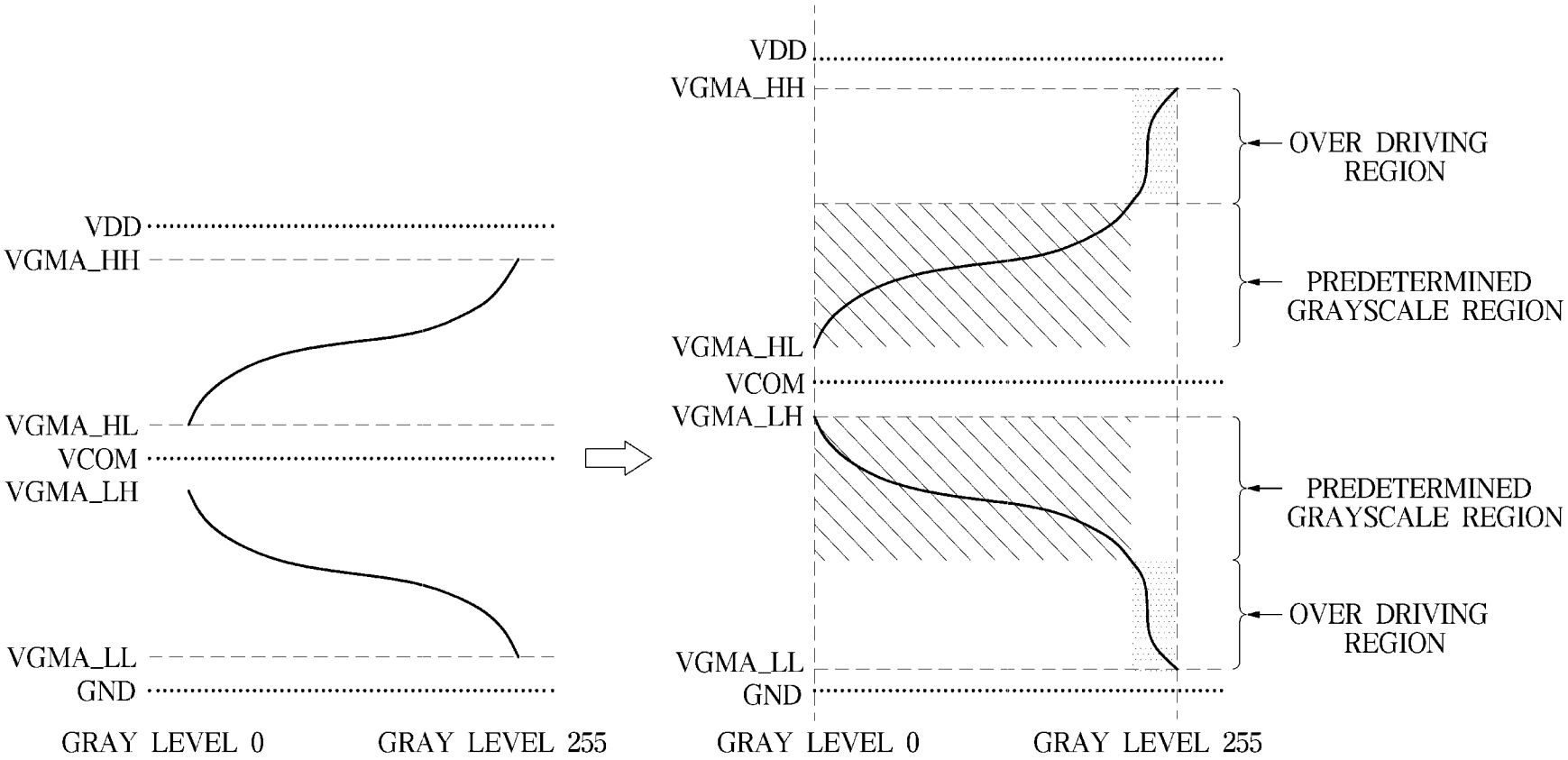
FIG. 7 is a diagram illustrating a gamma curve adjusted based on an increase in voltage of a source driver according to another embodiment.

FIG. 7 is a diagram illustrating a gamma curve adjusted based on an increase in voltage of the source driver 162 according to another embodiment.

Referring to FIG. 7, in the case of controlling the source driver 162 to increase the grayscale voltages allocated to all gray levels in response to the increase in the maximum voltage VDD, the processor 141 according to an embodiment may control the source driver 162 to increase grayscale voltages of the respective gray levels while constantly maintaining a gamma curve is maintained in the predetermined grayscale region before and after conversion of the screen mode.

Specifically, in the case of controlling the source driver 162 to increase a maximum positive polarity grayscale voltage VGMA_HH and a maximum negative polarity grayscale voltage VGMA_LH, respectively, in response to the increase in the maximum voltage VDD applied to the source driver 162, the processor 141 may control the source driver 162 to increase grayscale voltages of the respective gray levels in the predetermined grayscale region while constantly maintaining voltage intervals between the gray levels before and after conversion of the screen mode.

That is, the gamma curve of the grayscale voltage according to gray levels in the predetermined grayscale region may be the same before and after conversion of the screen mode. In other words, the gamma value in the predetermined grayscale region may be the same before and after conversion of the screen mode. Accordingly, the grayscale voltage range of the predetermined grayscale region may be the same before and after conversion of the screen mode.

In addition, the processor 141 according to an embodiment may control the source driver 162 to increase grayscale voltages of the respective gray levels such that the gamma curve of a grayscale region other than the predetermined grayscale region, i.e., the over driving region, is changed before and after conversion of the screen mode.

That is, the grayscale voltage in the over driving region may be increased (positive polarity) or decreased (negative polarity), via voltage stretch, from a grayscale voltage corresponding to the highest gray level in the predetermined grayscale region to a grayscale voltage VGAM_HH or VGAM_LL corresponding to the maximum gray level (e.g., gray level of 255).

As a result, the grayscale voltage range may be expanded after conversion of the screen mode in comparison with the grayscale region before conversion of the screen mode. However, the predetermined grayscale region may have the same voltage range before and after conversion of the screen mode. That is, the display apparatus 1 may provide over driving voltages with higher voltage levels and an expanded voltage range by expanding the grayscale region other than the predetermined grayscale region.

Accordingly, the display apparatus 1 may provide higher voltage levels and an expanded voltage range of over driving after conversion of the screen mode while providing grayscale voltages of the same gamma curve before and after conversion of the screen mode in the predetermined grayscale region so as to increase the response rate at a high gray level and prevent quality degradation of a displayed image.

As such, the display apparatus 1 of the present disclosure may provide an over driving voltage with a higher voltage level by expanding the driving voltage range and the grayscale voltage range of the source driver 162 and reducing the grayscale range used for image data without alternation with liquid crystals having a quick response rate or a driving system having a higher driving frequency, so that the response rate may be increased at a high gray level.

Hereinafter, an embodiment of a method of controlling the display apparatus 1 according to an aspect will be described. In the method of controlling display apparatus 1, the display apparatus 1 according to the above-described embodiment may be used. Therefore, the descriptions given above with reference to FIGS. 1 to 7 may also be equally applied to the method of controlling the display apparatus 1.

Figure 8:
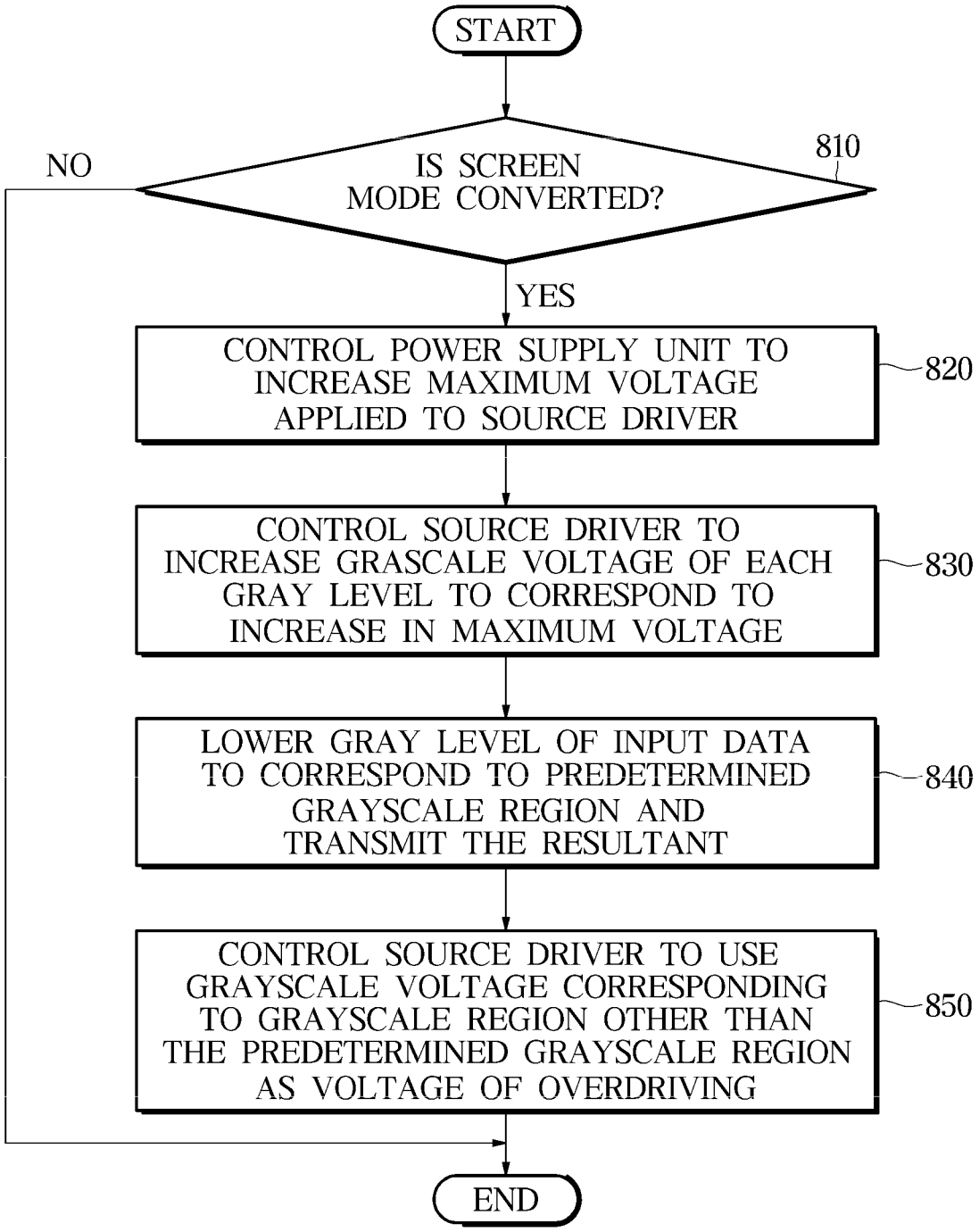
FIG. 8 is a flowchart of a method of controlling a display apparatus according to an embodiment.

FIG. 8 is a flowchart of the method of controlling the display apparatus 1 according to an embodiment.

Referring to FIG. 8, when the screen mode is converted (Yes of Operation 810), the display apparatus 1 according to an embodiment may control the power supply 150 to increase the maximum voltage VDD applied to the source driver 162 (820). Therefore, the range of the driving voltage of the source driver 162 may be expanded.

In this regard, conversion of the screen mode may be conversion from a screen mode not limiting a grayscale range (e.g., standard mode) into a screen mode limiting a grayscale range (e.g., movie mode), and the conversion of the screen mode may be performed based on the control command of the user input via the input interface 110 or automatically performed based on types of contents according to well-known algorithms.

The display apparatus 1 according to an embodiment may control the source driver 162 to increase grayscale voltages of the respective gray levels in response to the increase in the maximum voltage VDD (830).

Specifically, the processor 141 may expand a positive polarity grayscale voltage range VGMA_HL to VGMA_HH and a negative polarity grayscale voltage range VGMA_LL to VGMA_LH by controlling the source driver 162 to increase a maximum positive polarity grayscale voltage VGMA_HH and a maximum negative polarity grayscale voltage VGMA_LH, respectively, in response to the increase in the maximum voltage VDD applied to the source driver 162.

In this case, the processor 141 may control the source driver 162 to increase grayscale voltages of the respective gray levels to correspond to the increases in the maximum positive polarity grayscale voltage VGMA_HH and the maximum negative polarity grayscale voltage VGMA_LH, respectively.

That is, the processor 141 may control the source driver 162 to reallocate the grayscale voltages allocated to the respective gray levels in accordance with the increased maximum grayscale voltages VGMA_HH and VGMA_LH.

The processor 141 may also control the source driver 162 to increase the grayscale voltages of the respective gray levels while constantly maintaining the grayscale voltage range in the predetermined grayscale region before and after conversion of the screen mode.

The display apparatus 1 according to an embodiment may lower the gray levels of image data to correspond to the predetermined grayscale region and transmit the resultant to the source driver 162 (840).

In this case, the processor 141 may obtain image data corresponding to contents based on image processing of the contents obtained via the content receiver 120 or the communicator 130, lower the gray levels of the image data to correspond to the predetermined grayscale region by shrinking the image data, and transmit the resultant to the source driver 162.

That is, the processor 141 may lower gray levels of the respective pixels included in image data by a preset ratio such that the image data use only the gray levels of the predetermined grayscale region and transmit the shrunk image data to the source driver 162 via the timing controller 161, so that the source driver 162 may drive the liquid crystal panel 164 using grayscale voltages corresponding to the predetermined grayscale region.

The display apparatus 1 according to an embodiment may control the source driver 162 to use a grayscale voltage corresponding to a grayscale region other than the predetermined grayscale region as a voltage of over driving (850).

Specifically, when a gray level indicated by image data of a current frame is equal to or higher than a predetermined gray level, the processor 141 may control the source driver 162 to use a grayscale voltage corresponding to the over driving region as a voltage of over driving.

That is, the processor 141 may increase a response rate in a high-grayscale region by controlling the source driver 162 to apply a grayscale voltage of the over driving region for a high gray level higher than a predetermined gray level of the predetermined grayscale region.

In other words, in the case where a gray level indicated by image data after shrinking corresponds to a high gray level higher than a predetermined gray level, the processor 141 may control the source driver 162 to perform over driving by applying a grayscale voltage of the over driving region.

In this case, a grayscale voltage with a greater magnitude may be allocated to the over driving region in comparison with that allocated before conversion of the screen mode in accordance with increases in driving voltage and grayscale voltage applied to the source driver 162 in response to conversion of the screen mode, and therefore over driving may be performed more efficiently, thereby increasing the response rate.

As a result, the display apparatus 1 may increase the voltage levels of over driving in a high gray level and expand the voltage range of over driving by expanding the driving voltage range and the grayscale voltage range of the source driver 162 and reducing the grayscale range used by the image data, so that the response rate of the liquid crystals may be increased in the high gray level.

The aforementioned embodiments may be embodied in the form of a recording medium storing instructions executable by a computer. The instructions may be stored in the form of program codes and perform the operation of the disclosed embodiments by creating a program module when executed by a processor. The recording medium may be embodied as a computer readable recording medium.

The computer readable recording medium includes all types of recording media that store instructions readable by a computer such as read only memory (ROM), random access memory (RAM), magnetic tape, magnetic disc, flash memory, and optical data storage device.

While aspects of embodiments have been particularly shown and described, it will be understood that various changes in form and details may be made therein without departing from the spirit and scope of the following claims.

What is claimed is:

1. A display apparatus comprising:

a liquid crystal panel;

a source driver configured to output a grayscale voltage to the liquid crystal panel;

a power supply configured to provide a voltage to the source driver; and a controller configured to control the power supply and the source driver to change a maximum voltage provided to the source driver and the grayscale voltage based on conversion of a screen mode, and to set a predetermined grayscale region and an over driving region within an entire grayscale region, wherein the controller is further configured to:

based on the maximum voltage being increased according to the screen mode, control the source driver to increase each of a maximum positive polarity grayscale voltage and a maximum negative polarity grayscale voltage, and based on increases in the maximum positive polarity grayscale voltage and the maximum negative polarity grayscale voltage, control the source driver to increase grayscale voltages of respective gray levels so that a gamma curve is constantly maintained in the predetermined grayscale region before and after conversion of the screen mode.

2. The display apparatus according to claim 1, wherein the predetermined grayscale region is a grayscale region other than a region between a maximum gray level and a predetermined gray level from the entire grayscale region.

3. The display apparatus according to claim 2, wherein the controller is further configured to lower a gray level of image data to correspond to the predetermined grayscale region and provide the lowered gray level to the source driver.

4. The display apparatus according to claim 3, wherein the controller is further configured to control the source driver to use the grayscale voltage in the over driving region as a voltage of over driving.

5. The display apparatus according to claim 4, wherein the controller is further configured to, based on a gray level indicated by image data of a current frame being equal to or higher than the predetermined gray level, control the source driver to use the grayscale voltage corresponding to the over driving region as the voltage of over driving.

6. The display apparatus according to claim 1, wherein the controller is further configured to identify the maximum positive polarity grayscale voltage and the maximum negative polarity grayscale voltage based on a voltage range in which a gray level linearly changes in accordance with a voltage change in the liquid crystal panel.

7. The display apparatus according to claim 1, wherein the controller is further configured to control the source driver to increase grayscale voltages of the respective gray levels while changing the gamma curve in the over driving region before and after conversion of the screen mode.

8. The display apparatus according to claim 1, wherein the controller is further configured to control the power supply to increase a common voltage based on an increase in the maximum voltage.

9. The display apparatus according to claim 1, wherein the controller is further configured to control the power supply to increase the maximum voltage provided to the source driver based on conversion of the screen mode from a standard mode into a movie mode.

10. A method of controlling a display apparatus including a liquid crystal panel, a source driver configured to output a grayscale voltage to the liquid crystal panel, and a power supply configured to provide a voltage to the source driver, the method comprising:

controlling the power supply and the source driver to change a maximum voltage provided to the source driver and the grayscale voltage based on conversion of a screen mode; and setting a predetermined grayscale region and an over driving region within an entire grayscale region based on the maximum voltage being increased according to the screen mode, controlling the source driver to increase each of a maximum positive polarity grayscale voltage and a maximum negative polarity grayscale voltage, and based on increases in the maximum positive polarity grayscale voltage and the maximum negative polarity grayscale voltage, controlling the source driver to increase grayscale voltages of respective gray levels while constantly maintaining a gamma curve in the predetermined grayscale region before and after conversion of the screen mode.

11. The method according to claim 10, wherein the predetermined grayscale region is a grayscale region other than a grayscale region between a maximum gray level and a predetermined gray level from the entire grayscale region.

12. The method according to claim 11, further comprising lowering a gray level of image data to correspond to the predetermined grayscale region and providing the lowered gray level to the source driver.

13. A non-transitory computer readable recording medium having embodied thereon a program, which when executed by a processor of a display apparatus including a liquid crystal panel, a source driver configured to output a grayscale voltage to the liquid crystal panel, and a power supply configured to provide a voltage to the source driver, controls the display apparatus to execute a method, the method including:

controlling the power supply and the source driver to change a maximum voltage provided to the source driver and the grayscale voltage based on conversion of a screen mode; and setting a predetermined grayscale region and an over driving region within an entire grayscale region, based on the maximum voltage being increased according to the screen mode, controlling the source driver to increase each of a maximum positive polarity grayscale voltage and a maximum negative polarity grayscale voltage, and based on increases in the maximum positive polarity grayscale voltage and the maximum negative polarity grayscale voltage, controlling the source driver to increase grayscale voltages of respective gray levels while constantly maintaining a gamma curve in the predetermined grayscale region before and after conversion of the screen mode.

* * * * *